United States Patent [19]

Hagemeyer

[11] Patent Number: 4,630,420

[45] Date of Patent: Dec. 23, 1986

[54] DOOR

[75] Inventor: Bruce A. Hagemeyer, Pella, Iowa

[73] Assignee: Rolscreen Company, Pella, Iowa

[21] Appl. No.: 732,950

[22] Filed: May 13, 1985

[51] Int. Cl.[4] ..... E06B 3/70

[52] U.S. Cl. ..... 52/313; 52/455; 52/810; 52/811

[58] Field of Search ..... 52/313, 455, 456, 811, 52/807, 806, 810, 415, 416; 428/148, 193

[56] References Cited

U.S. PATENT DOCUMENTS

| | | | |
|---|---|---|---|
| 510,855 | 12/1893 | Grimstad | 52/313 |
| 1,187,545 | 6/1916 | Olberg . | |
| 1,951,983 | 3/1934 | Kellett . | |
| 2,249,590 | 7/1941 | Allen . | |
| 2,399,666 | 5/1946 | Een . | |
| 2,772,386 | 12/1956 | Buck . | |
| 2,774,698 | 12/1956 | Jenk et al. . | |
| 2,797,450 | 7/1957 | Ropella . | |
| 2,836,863 | 6/1958 | Denker . | |
| 3,077,424 | 2/1963 | Maker . | |
| 3,085,895 | 4/1963 | Gutman . | |
| 3,085,920 | 4/1963 | Taylor, Jr. . | |
| 3,254,592 | 6/1966 | Chase . | |
| 3,305,992 | 2/1967 | Steed | 52/455 |
| 3,371,003 | 2/1968 | Goldman | 428/192 |
| 3,375,031 | 3/1968 | Dargene | 52/716 |
| 3,380,875 | 4/1968 | Borup et al. . | |
| 3,385,743 | 5/1968 | Backberg | 428/191 |
| 3,391,020 | 7/1968 | Hochberg . | |
| 3,462,899 | 8/1969 | Sherman . | |
| 3,463,746 | 8/1969 | Murdock . | |
| 3,503,831 | 3/1970 | Oyama . | |
| 3,511,750 | 5/1970 | Hider . | |
| 3,589,974 | 6/1971 | Albrinck . | |
| 3,654,067 | 4/1972 | Klein . | |
| 3,669,727 | 6/1972 | Raymond . | |
| 3,677,868 | 7/1972 | Boggs . | |
| 3,713,935 | 1/1973 | Grecchi . | |
| 3,786,609 | 1/1974 | DiFazio . | |
| 3,994,110 | 11/1976 | Ropella . | |
| 4,060,437 | 11/1977 | Strout | 52/457 |
| 4,123,404 | 10/1978 | Lasher . | |
| 4,125,984 | 11/1978 | Jonas . | |
| 4,147,004 | 4/1979 | Day et al. . | |
| 4,204,987 | 5/1980 | Streets et al. . | |
| 4,247,583 | 1/1981 | Roy . | |
| 4,282,687 | 8/1981 | Teleskivi . | |
| 4,374,693 | 2/1983 | Pitt . | |

FOREIGN PATENT DOCUMENTS

| | | | |
|---|---|---|---|
| 115531 | 9/1979 | Japan | 52/313 |
| 144418 | 3/1954 | Sweden . | |
| 339745 | 3/1969 | Sweden . | |
| 321527 | 11/1929 | United Kingdom | 52/455 |

OTHER PUBLICATIONS 191,384 1/13/53/ Kloote, Published Abstract.

*Primary Examiner*—Henry E. Raduazo
*Attorney, Agent, or Firm*—Zarley, McKee, Thomte, Voorhees & Sease

[57] ABSTRACT

A thermal and moisture resistant door comprises a perimeter framework with a laminated skin glued to the interior and exterior sides of the framework, with an insulative core material therebetween. Laminated panels are secured to the skin on one or both sides of the door to provide the desired decorative appearance. Each skin and panel includes at least one cross-banding layer, a vapor barrier layer, and an outer veneer layer. Each panel is routed or molded such that an intermediate wood layer is visible, while the remaining layers of the panel are substantially concealed.

15 Claims, 5 Drawing Figures

DOOR

BACKGROUND OF THE INVENTION

Conventional doors are generally of the stile and rail variety or the flush variety. A stile and rail door is made up of several components, including stiles, rails and panels which are joined together with dowels or special corner joints. In comparison, a flush door may be constructed of either plywood or a steel skin placed over a perimeter frame with or without an interior core. The flush door is perceived by the public as a less expensive door than the stile and rail door and generally has less aesthetic appeal. Plant-ons or add-on panels may be attached to a flush door to give it a stile and rail appearance. Alternately, a stile and rail pattern may be embossed in the face of a steel door. Both the conventional stile and rail door and the flush door, as well as the add-on panels, are subject to warpage due to temperature differentials across the door and due to moisture absorption by the door. Also, plastic add-on panels are subject to melting deformation caused by the heat of the sun.

Therefore, a primary objective of the present invention is the provision of an improved door which is resistant to thermal and moisture deformation.

A further objective of the present invention is the provision of a laminated door having laminated add-on panels which simulate a stile and rail door.

Another objective of the present invention is the provision of a door having improved thermal insulative properties.

A further objective of the present invention is the provision of a door having increased strength.

Still a further objective of the present invention is the provision of a door with add-on panels, both of which include vapor barriers.

Another objective of the present invention is the provision of a door which is economical to manufacture, durable in use and aesthetically appealing.

SUMMARY OF THE INVENTION

The door of the present invention has increased strength and is resistant to thermal and moisture deformation. The door includes a perimeter framework with a laminated skin attached thereto on both the interior and exterior sides of the door, and at least one laminated decorative panel secured to the skin to provide the door with the desired appearance, such as stile and rail. A core of insulative material between the interior and exterior skins and within the framework improves the thermal insulative characteristics of the door.

Each layer of the skin and of the add-on panel is glued to adjacent layers. The skin includes an inner backer layer, a first cross-banding layer, an aluminum vapor barrier layer, a second cross-banding layer, and an outer wood veneer layer. The decorative panel includes an inner first cross-banding layer, an intermediate wood layer, a second cross-banding layer, an aluminum vapor barrier layer, a third cross-banding layer, and an outer wood veneer layer. The inner layers of the skin are concealed by the outer veneer layer thereof. The edges of the panels are routered such that the intermediate wood layer and outer veneer layer are visible while the cross-banding and vapor barrier layers are substantially concealed. The various layers of the skins and panels increase the strength, warp resistance and thermal bow resistance of the door.

DETAILED DESCRIPTION OF THE PREFERRED EMBODIMENT

Figure 1:
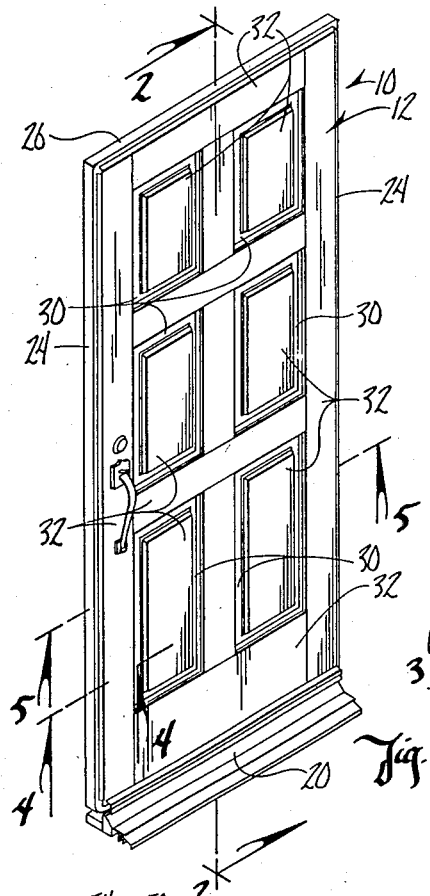
FIG. 1 is a perspective view of the door of the present invention.

The reference numeral 10 generally designates the door of the present invention. Door 10 has an exterior side 12 and an interior side 14 and is mounted in the entryway of a building which includes a door header 16, a threshold 18 with a door sill 20, opposite lock and hinge jambs (not shown), and a door stop member 22 attached to header 16 and the lock jamb adjacent the exterior side of the door. The entryway construction is conventional and not part of the present invention.

Door 10 has a perimeter framework including opposite elongated side frame members 24, a top frame member 26 extending between side frame members 24 at the upper ends thereof, and a bottom frame member 28 extending between said frame members 24 at the lower ends thereof. A laminated skin 30 is attached to the perimeter framework on both the interior and exterior sides of door 10. Also, one or more add-on panels 32 are attached to skin 30 on one or both sides of door 10 for decorative and aesthetic purposes. For example, in FIG. 1, panels 32 have been added to give door 10 a stile and rail appearance.

Figure 3:
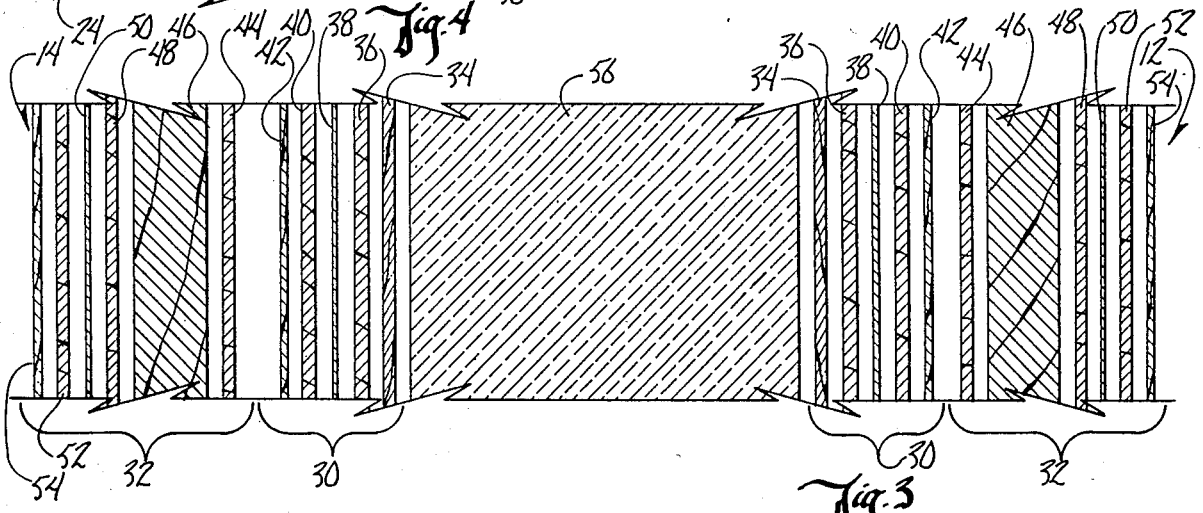
FIG. 3 is an exploded sectional view taken along lines 3—3 of FIG. 2.
Figure 5:
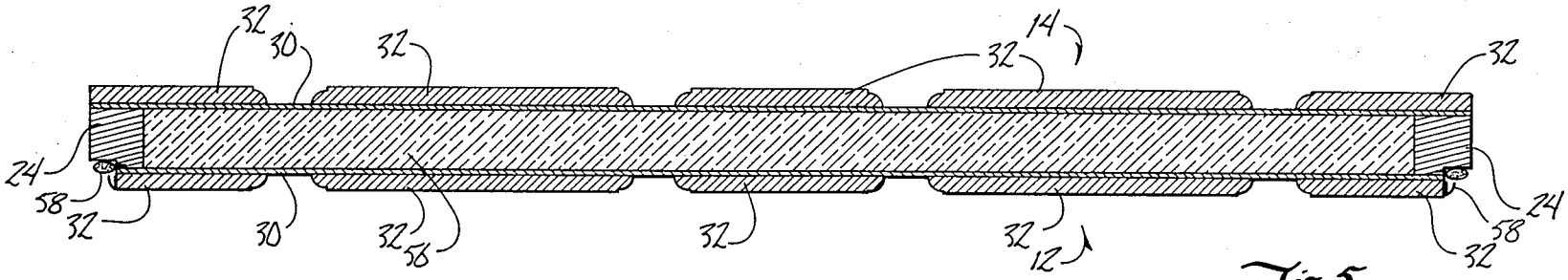
FIG. 5 is a sectional view taken along lines 5—5 of FIG. 1.

The construction of skins 30 and panels 32 are best shown in FIG. 3. Both skin 30 and panels 32 are of laminated construction with a layer of glue (not shown) securing each skin or panel layer to the adjacent layer. An example of a satisfactory glue is 42–200 Plyophen ® PGL, a dry phenolic film adhesive manufactured by Reichhold Chemicals, Inc. of Tacoma, Washington, which is applied with heat and pressure.

More particularly, each skin 30 includes an inner backer layer 34, a first cross-banding layer 36, a vapor barrier layer 38, a second cross-banding layer 40, and an outer veneer layer 42. Preferably, backer layer 34 and cross-banding layers 36 and 40 are constructed of straight grained wood, such as poplar, while outer veneer layer 42 is a hard wood, such as oak. Vapor barrier 38 is preferably aluminum or another similar moisture impervious material. As seen in FIG. 3, the grain direction of backer layer 34 and outer veneer layer 42 runs the length of the door, while the grain direction of cross-banding layers 36 and 40 runs the width of the door so as to provide strength to the door.

The thickness of each layer of skin 30 varies. However, backer layer is preferably 0.036 inch, with a range of 0.015–0.060 inch; cross-banding layers 36 and 40 are preferably 0.062 inch, with a range of 0.015–0.060 inch; vapor barrier layer 38 is preferably 0.010 inch, with a range of 0.002–0.020 inch; and outer veneer layer 42 is preferably 0.033 inch, with a range of 0.015–0.060 inch.

Add-on panel 32 includes a first cross-banding layer 44, an intermediate wood layer 46, a second cross-banding layer 48, a vapor barrier layer 50, a third cross-banding layer 52, and an outer veneer layer 54. As in skin 30, the cross-banding layers 44, 48 and 52 of panel 32 are preferably constructed of straight grained wood, such as poplar, with the grain direction running across the width of door 10 while outer veneer layer 54 is of a hard wood, such as oak, with the grain direction running along the length of door 10. Preferably, veneer layers 42 and 54 are made of the same wood. Also, vapor barrier layer 50 is constructed of aluminum or another moisture impervious material. Intermediate wood layer 46 is preferably Meranti, but may be the same or similar type wood as outer veneer layer 54. Also, wood layer 46 is stained to match veneer layers 42 and 54.

It is understood that the thicknesses of the layers of panel 32 may vary. However, cross-banding layers 44, 48 and 52 are preferably 0.036 inch, with a range of 0.015–0.060 inch; intermediate wood layer 44 is preferably 0.261 inch, with a range of 0.125–0.475 inch; vapor barrier layer 50 is preferably 0.002, with a range of 0.002–0.020 inch; and outer veneer layer 54 is preferably 0.033 inch, with a range of 0.015–0.060 inch.

Figure 4:
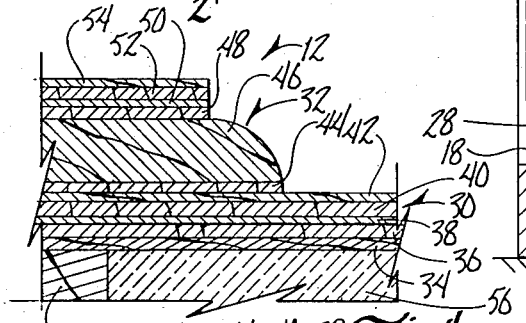
FIG. 4 is a partial sectional view taken along lines 4—4 of FIG. 1.

As best seen in FIG. 4, panel 32 may be routed or molded such that a portion of intermediate wood layer 46 is substantially visible. Thus, to a person viewing door 10 head on, only outer veneer layer 42 of skin 30, intermediate wood layer 46 of panel 32, and outer veneer layer 54 of panel 32 are visible. The cross-banding layers 44, 48, and 52 and the vapor barrier layer 50 of panel 32 are not generally visible, except upon close inspection of the panel. The various layers of skins 30 beneath outer veneer layer 42 are also not subject to view. Thus, door 10 appears to be of solid wood construction and the aesthetic qualities of the door are maintained.

The interior of door 10 is filled with an insulative material 56, such as foam. Material 56 fills the space between the interior nd exterior skins and within the framework of the door.

Figure 2:
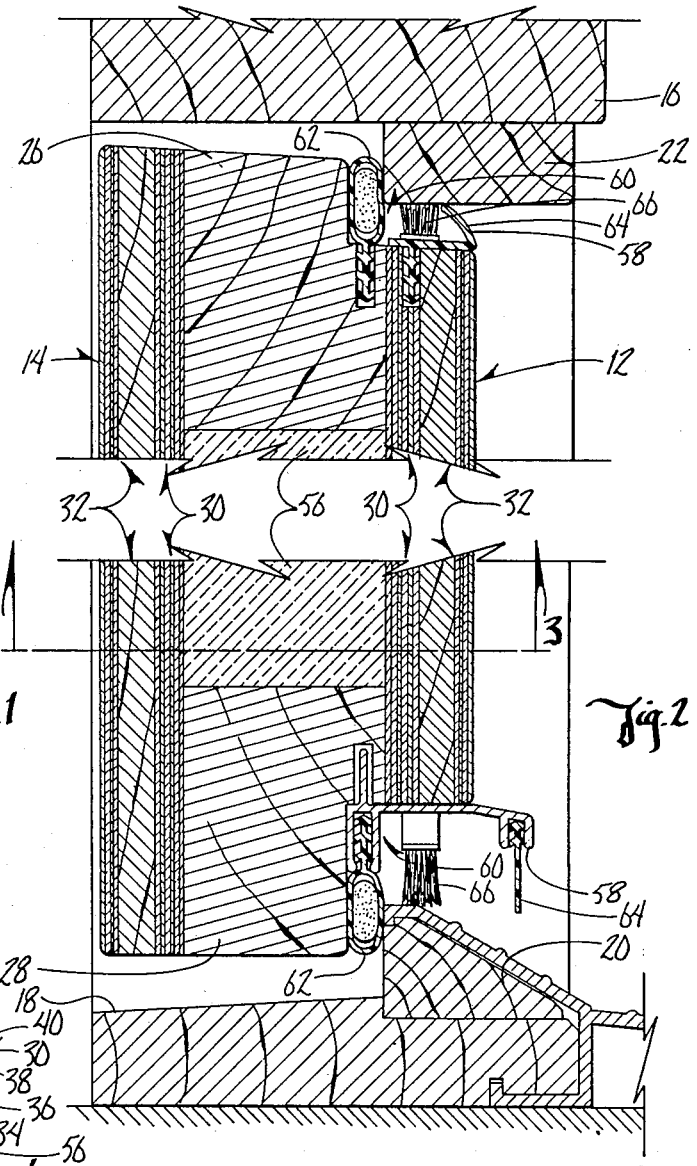
FIG. 2 is a sectional view taken along lines 2—2 of FIG. 1.

Door 10 may be further provided with weatherstripping means 58, as seen in FIG. 2. For example, door 10 may include a notch 60 around the forward peripheral edge, such that a first compressible weatherstripping member 62 can be mounted on notch 60 for compressive sealing engagement with threshold 20 and door stop member 22, as seen in FIG. 2. An elongated flexible leaf 64 can be mounted along each edge of door 10 forwardly of first weatherstripping member 62 to function as a rain screen to prevent moisture from reaching first weatherstripping member 62. A bristled element 66 is mounted on the corners of door 10 between first weatherstripping member 62 and flexible leaf 63 to fill the corner gap between the ends of adjacent flexible leafs.

Also, a layer of aluminized steel or the like may be provided within door 10 for fireproofing.

The laminated construction of skins 30 and panels 32 provide strength to door 10. This strength, along with the insulative quality of material 56, prevents door 10 from warping due to temperature differentials across the door. Also, vapor barrier layer 38 of skins 30 prevent door 10 from warping due to moisture absorption, while vapor barrier layer 50 of panels 32 prevent warping of the panels due to moisture absorption. Also, the laminated construction of panels 32 prevents the panels from warping due to intense heating by the sun.

The construction of door 10, including laminated skins 30, laminated panels 32 and insulative core 56, provides door 10 with an insulative R-value of at least 10, as compared to the typical R-value of 2 or 3 for a conventional stile and rail door.

Thus, the present invention accomplishes at least all of its stated objectives.

What is claimed is:

1. A thermal and moisture resistant door, comprising:

a framework defining the perimeter edges of said door and defining the interior and exterior sides of said door, said framework including opposite elongated side frame members, a top frame member extending between said side frame members at the upper ends thereof, and a bottom frame member extending between said side frame members at the lower ends thereof;

a laminated skin secured to said framework on the interior and exterior sides of said door, said skin including an inner wood backer layer attached to said framework and having the wood grain running substantially parallel to the length of the door, a first wood cross-banding layer attached to said backer layer and having the wood grain running substantially perpendicular to the length of the door, a vapor barrier layer attached to said first cross-banding layer, a second wood cross-banding layer attached to said vapor barrier layer and having the wood grain running substantially perpendicular to the length of the door, and an outer wood veneer layer attached to said second cross-band layer and having the wood grain running substantially perpendicular to the length of the door;

a laminated panel secured to said skin on at least one side of said door, said panel including an inner first wood cross-banding layer attached to said veneer layer of said skin, an intermediate wood layer attached to said first cross-banding layer, a second wood cross-banding layer attached to said intermediate wood layer, a vapor barrier layer attached to said second cross-banding layer, a third wood cross-banding layer attached to said vapor barrier layer and an outer wood veneer layer attached to said third cross-banding layer, the wood grain of said intermediate layer and the wood grain of said veneer layer running substantially parallel to one another and the wood grain of at least one of said cross-banding layers running substantially perpendicular to the wood grain of said veneer layer;

wherein the layers of lamination of said skins provide strength to the door to prevent warping of the door due to temperature differentials across the door;

wherein the layers of lamination of said panel provide strength to the door and panel to prevent warping of the door and panel due to temperature differentials across the door and panel;

wherein said vapor barriers in said skins prevent warping of the door due to moisture absorption thereby; and wherein said vapor barrier in said panel prevents warping of the panel due to moisture absorption thereby.

2. The door of claim 1 wherein said intermediate layer of said panel is substantially thicker than the other layers of said panel and said panel is routered along at least one edge so as to provide an edge to said first cross-banding layer which is substantially perpendicular to the surface of the veneer layer of said skin and to provide an enlarged surface of said intermediate layer and to provide coplanar edges to said second and third cross banding layer, said vapor barrier layer and said veneer layer which are substantially perpendicular to the surface of said veneer layer of said skin, whereby said enlarged surface of said intermediate layer is visible adjacent said routered edge and said edges of said cross banding layers, said vapor barrier layer and said veneer layer of said panel are substantially concealed from view with a line of sight substantially perpendicular to the surface of the veneer layer of the skin.

3. The door of claim 1 further comprising insulative material between said skins and within said framework.

4. The door of claim 1 wherein said backer layer of said skins and said cross-banding layers of said skins are straight grained wood.

5. The door of claim 1 wherein said vapor barrier layers of said skins are aluminum.

6. The door of claim 1 wherein said veneer layer of said skins is hardwood.

7. The door of claim 1 wherein said backer layer of said skins and said cross-banding layers of said skins range in thickness from 0.015 inch to 0.060 inch, said vapor barrier layer ranges in thickness from 0.002 inch to 0.020 inch, and veneer layer of said skins ranges in thickness from 0.015 inch to 0.060 inch.

8. The door of claim 1 wherein said cross-banding layers of said panel are straight grained wood.

9. The door of claim 1 wherein said vapor barrier layer of said panel is aluminum.

10. The door of claim 1 wherein said veneer layer of said panel is hard wood.

11. The door of claim 1 wherein said cross-banding layers of said panel range in thickness from 0.015 inch to 0.060 inch, said intermediate wood layer of said panel ranges in thickness from 0.125 inch to 0.475 inch, said vapor barrier layer of said panel ranges in thickness from 0.002 inch to 0.020 inch and said veneer layer of said panel ranges in thickness from 0.015 inch to 0.060 inch.

12. The door of claim 1 further comprising a layer of adhesive between said skin and said framework for securing said skin to said framework and a layer of adhesive between said panel and said skin for securing said panel to said skin.

13. The door of claim 1 further comprising a layer of adhesive between each layer of said skin for securing adjacent skin layers together and between each layer of said panel for securing adjacent panel layers together.

14. The door of claim 1 wherein the thermal R value thereof is at least 10.

15. The door of claim 1 wherein said portion of said intermediate wood layer is treated to match said outer veneer layer of said panel.

* * * * *